US005980158A

United States Patent [19]

Griffiths et al.

[11] Patent Number: 5,980,158

[45] Date of Patent: Nov. 9, 1999

[54] BUOYANCY COMPENSATION DEVICE WITH RESTRAINING MEANS

[76] Inventors: John M. Griffiths, 251 Tompkins Rd., Montgomery, N.Y. 12549; John Thomas Crea, 7813 Carriage La., Panama City, Fla. 32404

[21] Appl. No.: 09/179,636

[22] Filed: Oct. 27, 1998

Related U.S. Application Data

[63] Continuation of application No. 08/500,055, Jul. 10, 1995, abandoned.

[51] Int. Cl.[6] ..... B63C 11/02; B63C 9/08

[52] U.S. Cl. ..... 405/186; 441/88; 441/121

[58] Field of Search ..... 405/186, 185, 405/68; 441/88, 106, 114–119, 121, 41, 40, 42, 54; 152/156; 5/628

[56] References Cited

U.S. PATENT DOCUMENTS

| | | | |
|---|---|---|---|
| 1,205,033 | 11/1916 | Seely . | |
| 2,905,954 | 9/1959 | Lanciano | 441/116 |
| 3,026,548 | 3/1962 | Dollinger | 441/115 |
| 4,035,857 | 7/1977 | Briley et al. | 441/118 |
| 5,785,567 | 7/1998 | Modugno | 441/88 |

FOREIGN PATENT DOCUMENTS

| | | | |
|---|---|---|---|
| 00170438 | 2/1992 | U.S.S.R. | 441/116 |

*Primary Examiner*—Dennis L. Taylor

*Attorney, Agent, or Firm*—Nims, Howes, Collison Hansen & Lackert

[57] ABSTRACT

A buoyancy compensation device has a plurality of guide assemblies disposed about its outer and inner periphery, such that a plurality of resilient bands can each be disposed in a pair of complementary guide assembles, the bands biased to restrain expansion of the bladder when deflated or partially inflated to reduce drag, increase comfort and improve air distribution.

15 Claims, 3 Drawing Sheets

BUOYANCY COMPENSATION DEVICE WITH RESTRAINING MEANS

CROSS REFERENCE TO RELATED APPLICATIONS

This application is a continuation in part of application Ser. No. 08/500,055 filed Jul. 10, 1995, now abandoned.

TECHNICAL FIELD

This invention relates to a buoyancy compensation device having a plurality of grommets disposed about its periphery for receiving resilient bands which restrain the buoyancy compensation device when deflated or partially inflated.

BACKGROUND

A buoyancy compensation device is used by a diver to adjust buoyancy during a dive. Such a device is commonly used to off-set buoyancy changes induced as a diver descends while wearing a neoprene wet suit. Such a wet suit is quite buoyant at the surface of the water because air is trapped in the neoprene. Typically, a diver will wear weights to off-set this positive buoyancy to assist in descending. As the diver descends however, the air trapped in the neoprene compresses, reducing the positive buoyancy such that the deeper the diver descends, the more negative the buoyancy becomes. A buoyancy compensation device (BCD) typically has at least one air chamber which the diver fills with air to off-set this increasing negative tendency, to thus maintain neutral buoyancy regardless of the depth of the dive. Conversely, as the diver ascends, air is released from the BCD to avoid rising too quickly as with the reduced pressure, the air in the neoprene expands, increasing positive buoyancy.

In U.S. Pat. No. 5,516,233, a buoyancy compensator is described that also functions as a safety device.

In U.S. Pat. No. 5,562,513, a buoyancy compensator is described that is integral with a back pack and harness structure for supporting a tank of compressed air on the back of a diver.

These devices fail to address a problem with BCD's. For example, the device shown in FIGS. 9 and 10 of the '233 Patent illustrates that the device inflates completely about the periphery. It has been found that such BCD's, when inflated can be uncomfortable, in that they tend to bulge in the areas closest to the surface, regardless of the orientation of the diver, and that even partially inflated, they tend to expand to the point that they induce drag while the wearer is swimming in or on the surface of the water. Further, at present, there are no devices which allow for the adjustment of the buoyancy compensation device in different areas about its periphery or to assure equalization of pressure to avoid air shifts during diving as the diver changes orientation.

SUMMARY OF THE INVENTION

It is an object of the present invention to provide a buoyancy compensation device with means to adjust the degree of expansion of the buoyancy compensation device in accordance with different degrees of inflation without affecting the overall buoyancy of the device.

It is a further object to provide a buoyancy compensation device that improves comfort by adjusting the degree of BCD expansion, thereby reducing drag while swimming.

These and other objects of the present invention are achieved by a buoyancy compensation device comprising a bladder having an air chamber therein, a plurality of guide assemblies disposed about an outer periphery of the bladder, a corresponding plurality of guide assemblies disposed about an inner periphery of the bladder, and, resilient restraining means extending circumferentially about the bladder and passing through at least one corresponding pair of inner and outer guide assemblies, the restraining means biased to exert a restraining force on the expansion of the bladder.

Preferably, the inventive bladder has, for example, about twelve eyelet assemblies disposed about the outer periphery of the bladder, and a corresponding twelve holes disposed about an inner periphery of the bladder associated with a back plate used to support an air cylinder. Up to twelve elastic bands are provided, each band passing through a pair of corresponding eyelets and holes, each band then having the ends attached preferably by tying such that the elastic bands are stretched to exert a restraining force on the bladder so as to compact and restrain the bladder in the range of from full deflation to full inflation.

Using the inventive buoyancy compensation device, comfort is increased as the bladder maintains a minimized profile when partially inflated, which reduces drag when swimming. In addition, the elastic bands exerts sufficient force so as to equalize air distribution within the bladder and thereby avoid significant air shifting about the bladder as the diver changes orientation.

DETAILED DESCRIPTION OF THE INVENTION

Figure 1:
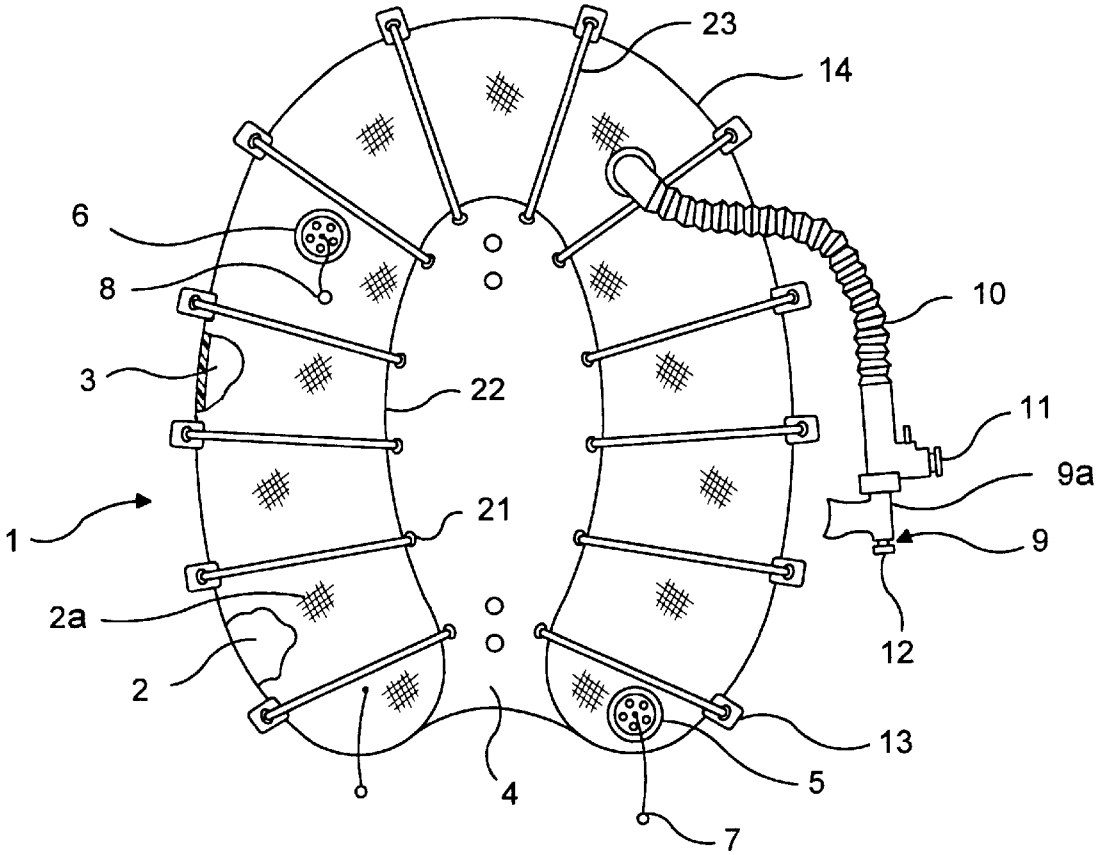
FIG. 1 is a front view of the buoyancy compensation device in accordance with the present invention.

Referring to FIG. 1, a buoyancy compensation device 1 has a bladder 2, defining at least one air chamber 3 therein, attached to a back plate 4. The bladder is covered by a protective covering, 2*a*, which may be, for example, ballistic nylon, to protect the bladder from punctures. The bladder has a substantially horseshoe shape and includes two over pressurization relief valves 5 and 6, to accommodate head down or head up venting of the bladder. The bladder has two pull cords 7 and 8 which actuate the valves to release air from the air chamber, though the valves would open automatically in a high pressure condition to prevent bladder bursting.

An inflation device 9 is connected by a hose 10 to the bladder, the device 9 including a pair of actuators 11 and 12, one used to inflate the bladder 1 and one used to deflate the bladder 1. A mouthpiece 9*a* provided for manual inflation.

The bladder is further equipped with a plurality of guide assemblies 13 which are distributed about an outer periphery 14 of the bladder. These may be evenly spaced about the periphery or concentrated in specific areas such as at the head or sides, as desired, though equal spacing is preferred. The guide assemblies are preferably bonded or otherwise fixed directly to the bladder or its covering.

Generally, from 4 to 20 guide assemblies may be provided, the number depending on the size of the overall bladder. With a typical bladder, about twelve guide assemblies are preferred.

Figure 2:
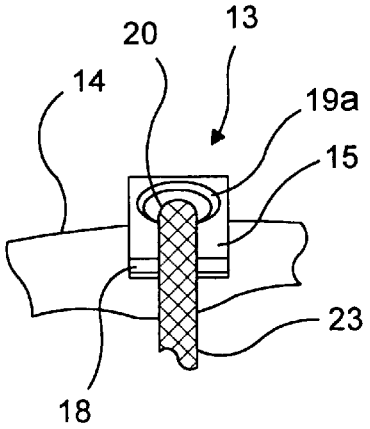
FIG. 2 is an enlarged view of an eyelet assembly and restraining strap.
Figure 3:
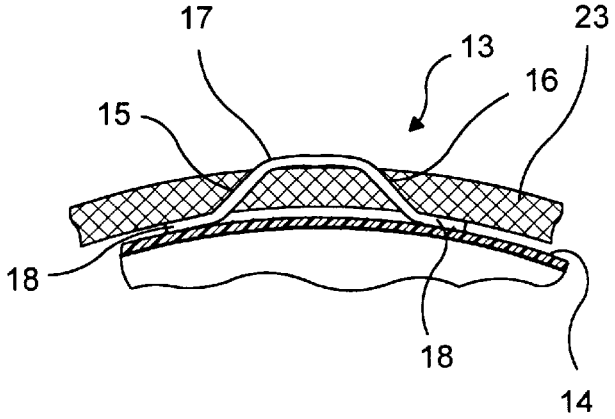
FIG. 3 is a cross sectional view of the eyelet assembly of FIG. 2.

Referring to FIGS. 2 and 3, each guide assembly 13 has a forward wall 15, a rearward wall 16 and a top wall 17 which may simply comprise a strip of folded nylon webbing. The strip has a pair of ends 18 bonded to the surface of the bladder. Within the webbing strip, a pair of grommets 19, 19*b*, with each grommet having an opening 20 therein, the openings being substantially coaxial.

Referring again to FIG. 1, the back plate 4 has a number of inner guide assemblies, formed as holes 21, the number normally corresponding to the number of outer guide assemblies. These inner guide assemblies are located about an inner periphery 22 of the bladder 2. The holes are provided in the back plate 4 though other forms of guide assembly will be described below.

A plurality of means for restraining the bladder 23 are threaded through the grommets 19 and the back plate holes 21. These means comprise one or more bands made of a resilient material. While the term "bands" is used, the restraining means are not limited to flat bands but may include various types and shapes of straps, tubing, or other resilient members, preferably having a pair of ends that can be attached together for tightening or loosening to adjust the degree of bias.

Various materials can be used to form the restraining means and these may be made of any resilient flexible material such as silicone elastomer, natural or synthetic rubber, fluoroelastomer, etc., and combinations thereof. One material which is preferred for its implicitly is implant grade medical silicone tubing, because it is flexible and strong yet it can be broken if a band becomes snagged during a dive. In addition, the tubing makes it relatively easy for a user to tie the ends together, tubing being simply easier to handle.

As shown in FIG. 1, twelve bands 23 are provided about the bladder. In this view, the bladder is fully inflated and the bladder achieves its natural full contour, that is, the bands do not diminish the ability to fully inflate the bladder to obtain positive buoyancy.

Figure 4:
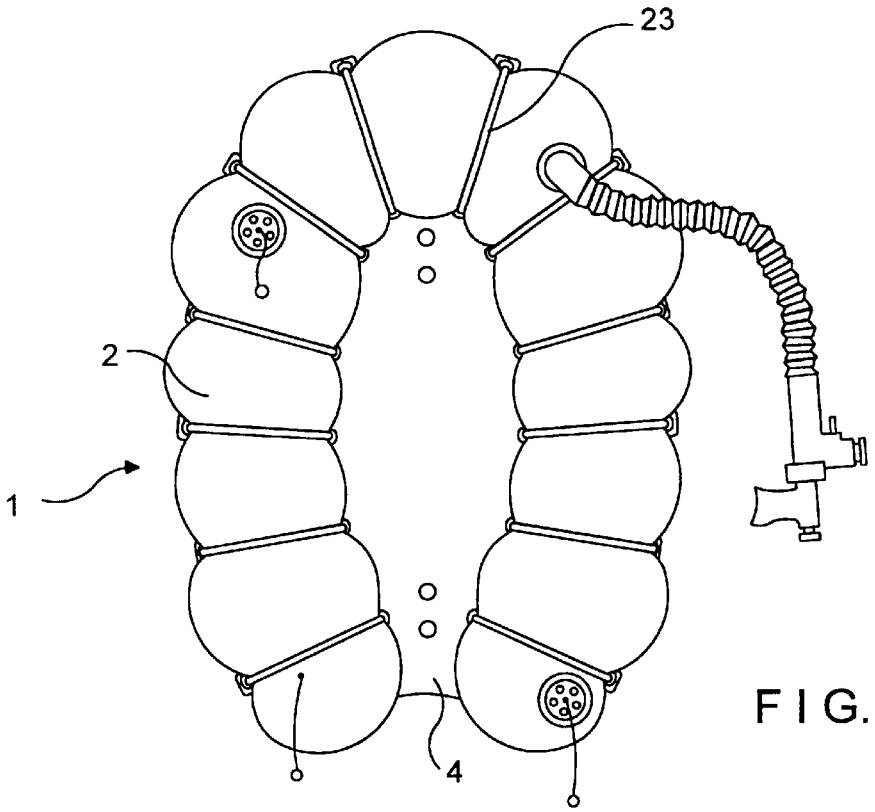
FIG. 4 is a front view of the buoyancy compensation device of FIG. 1 in a partially inflated condition.

Referring to FIG. 4, the bladder 2 is shown partially inflated. Here, the contour of the bladder is altered by the bands 23 such that the bladder is contracted in conformance with the lesser degree of inflation. Without the resilient bands, the contour would shift, depending on the position of the diver, the most air being in the highest portion of the bladder. Such air shifting can be a nuisance and distraction as the diver changes orientation during a dive, and without the bands, even partially inflated, the bladder will generally produce a fuller bladder profile with consequent drag as the diver attempts to swim through the water.

Figure 5:
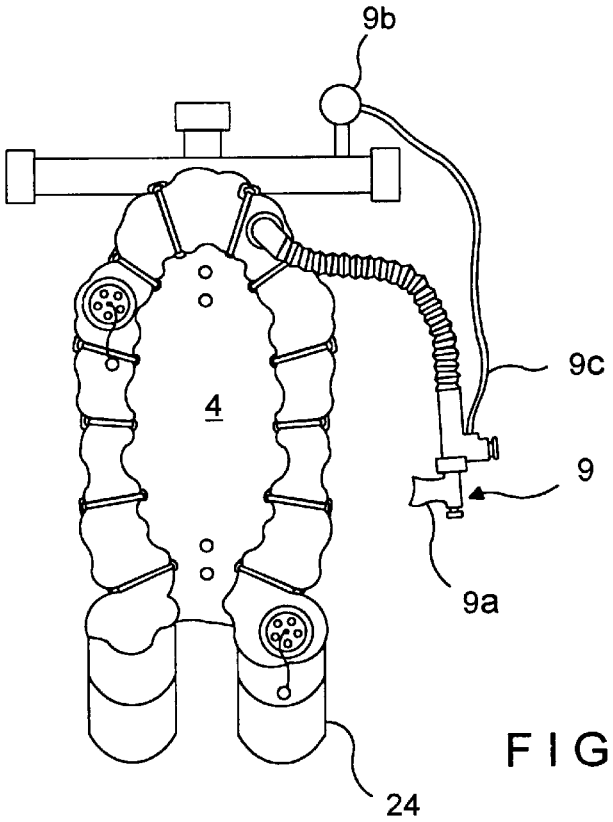
FIG. 5 is a front view of the buoyancy compensation device of FIG. 1 in a deflated condition and with associated air cylinders.

Referring to FIG. 5, the bladder 2 is shown completely deflated, and here, it is quite evident that the bands 23 substantially reduce not only the contour of the bladder, but further neatly tuck the bladder in close to the back plate 4 to reduce the exposure of the bladder to damage for example when moving air cylinders 24 attached to the back plate 4 prior to a dive. Also shown in FIG. 5 is a regulator 9*b* and hose 9*c* which provide air to the device 9 for power inflation.

The resilient bands of the present invention thus not only reduced the profile but also assist in maintaining even air distribution about the periphery of the bladder, and reduce exposure of the bladder when in a deflated condition to minimize damage.

It is important that the bands be biased so as to restrain the bladder when empty. This assures that when partially inflated, the bands have sufficient bias to reduce the contour of the bladder. Also, as the bladder is inflated, the degree of bias increases, to assist in the even air distribution capability of the multiple band construction, though the bias should never prevent full inflation of the bladder.

While a single band could be threaded through the holes and grommets, individual bands are preferred, in case a snag occurs and the band must be cut. In addition, this also allows the user to set the degree of bias, for example, by tying the ends either tighter or looser at the sides or head, and to select how many bands may be applied. For example, it may not be necessary to use all twelve bands during a relatively shallow dive, or it may be preferred to distribute the air differently about the periphery. For example, the user may wish to add additional buoyancy to one side where he expects to carry more equipment and thus it would be advantageous to reduce the number of bands or their degree of bias, on the side where the equipment will be carried to improve overall buoyancy.

Figure 6A:
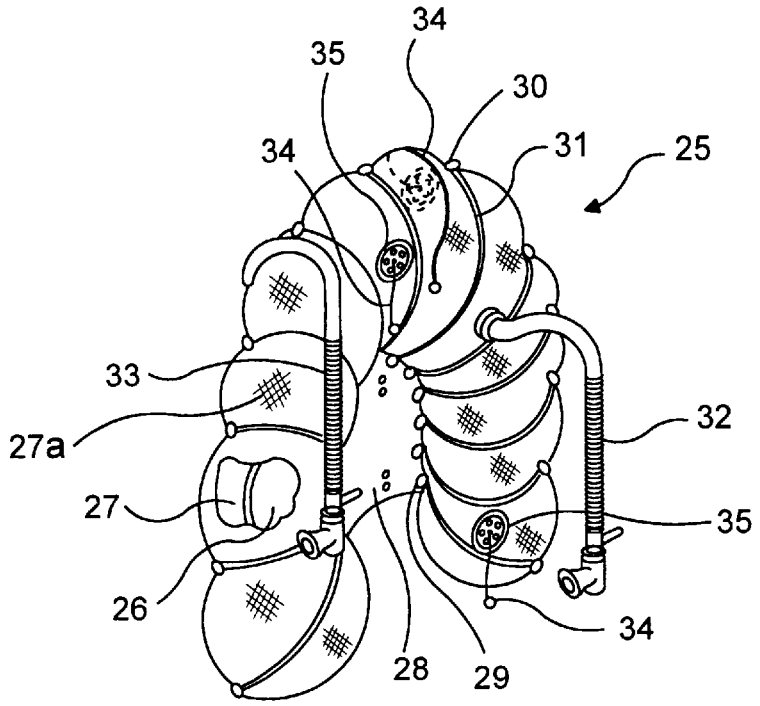
FIG. 6*a* is a front view of a buoyancy compensation device which has dual bladders, which are fully inflated.
Figure 6B:
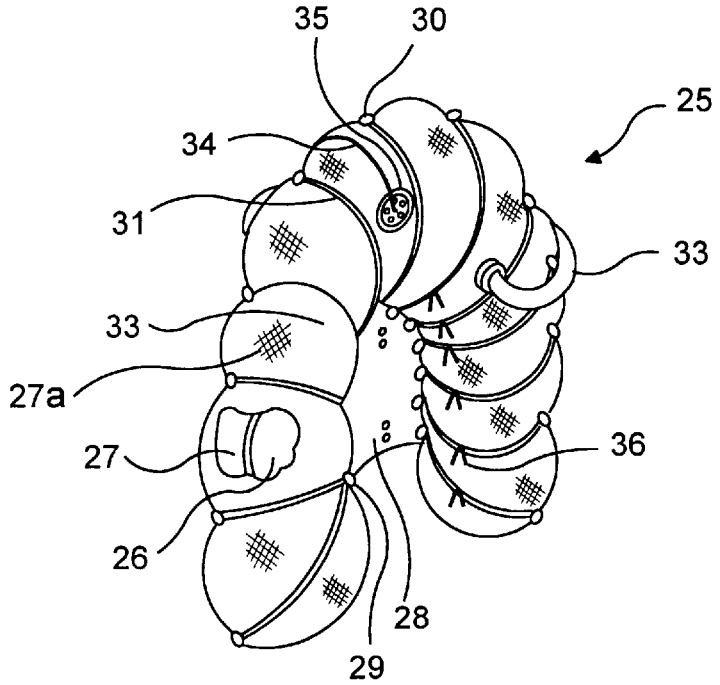
FIG. 6*b* is a back view thereof.

Referring to FIGS. 6*a* and 6*b*, a dual bladder buoyancy compensation device 25 is shown, FIG. 6*a* being a front view, FIG. 6*b* being a back view. In this embodiment, two essentially identical bladders 26 and 27 are provided, front to back, a back plate 28 located therebetween or attached to a protective covering 27*a*. The bladders are covered by the protective, 27*a*, which may be, for example, ballistic nylon, to protect the bladders from puncture. This provides redundancy in the event that there is a failure of one bladder. The only distinction is that there are still only twelve holes 29 associated with twelve outer guide assemblies 30 and twelve individual bands 31, the bands surrounding the circumference of the pair of mated bladders. Because there are two bladders, two inflation devices 32 and 33 are provided on the front side for diver activation, and pull cords 34, which activate relief valves 35 on the front and back, are also positioned for convenient diver use. Further, the inflation devices 32 and 33, which shown on opposite sides, could both be on the same side if desired.

As shown in FIG. 6*b*, the individual bands 31 each have a pair of ends 36 which are tied together on the rear side of the bladder. Of course other joining means may be used such as utilizing a hook and loop structure to facilitate engagement and disengagement of the band ends. Snaps or buckles or other attachment devices may similarly be used and the invention is not limited to utilizing tied ends.

The bladders are constructed of conventional materials such as polypropylene, rubber, etc. which is covered preferably with ballistic nylon having a PVC backing. The devices associated with the bladder, such as the relief valves, hoses and inflation devices, are also of conventional construction.

The inner and outer guide assemblies while shown as a pair of grommets disposed in nylon webbing, or as holes in the back plate, could comprise other structures such as for example a flexible rubber or silicon tube bonded to the bladder and through which the restraining means may pass. Another possible alternative is to use a sewn nylon pocket which has open ends and through which again the band may pass. Any structure which holds the band in its designated position may be used and it should be understood that there is no requirement to provide a back plate with holes, as similar guide assemblies can be used about the inner and outer periphery of the bladder and the above described embodiment is merely a preferred embodiment of the present invention.

While preferred embodiments of the present invention have been shown and described it will be understood by those skilled in the art that various changes or modifications could be made without varying for the scope of the present invention.

We claim:

1. A buoyancy compensation device comprising a bladder having an air chamber, a plurality of outer guide assemblies located about an outer periphery of the bladder, a corresponding plurality of inner guide assemblies located about an inner periphery of the bladder, and means for restraining the bladder disposed about the circumference of the bladder, and passing through at least one pair of corresponding inner and outer guide assemblies, the restraining means biased to exert a restraining force to limit expansion of the bladder prior to or when inflated.

2. The buoyancy compensation device of claim 1 further comprising a back plate, the bladder attached to the back plate, the plurality of inner guide assemblies located about the inner periphery of the bladder being holes incorporated in the back plate.

3. The buoyancy compensation device of claim 1 wherein at least one outer or inner guide assembly comprises a grommet, having an opening therein, attached to the bladder.

4. The buoyancy compensation device of claim 1 wherein at least one inner or outer guide assembly comprises a strip of flexible webbing attached to the bladder, a pair of grommets disposed in the webbing, each grommet having an opening for receiving the restraining means therein, the openings being substantially coaxial.

5. The buoyancy compensation device of claim 1 further comprising a plurality of restraining means, each restraining means associated with a pair of corresponding inner and outer guide assemblies, each restraining means having a pair of ends which are engagable together.

6. The buoyancy compensation device of claim 1 wherein the restraining means are one or more elastic bands made of a resilient material.

7. The buoyancy compensation device of claim 1 wherein from four to twenty guide assemblies are provided about the outer periphery of the bladder.

8. The buoyancy compensation device of claim 1 wherein from four to twenty restraining means are disposed about the circumference of the bladder.

9. The buoyancy compensation device of claim 1 wherein the restraining means are composed of a material selected from the group consisting of silicone elastomer, natural rubber, synthetic rubber, fluoroelastomer and combinations thereof.

10. The buoyancy compensation device of claim 1 further comprising a second bladder attached to the bladder, the restraining means disposed about the circumference of both bladders, each corresponding pair of inner and outer guide assemblies being disposed about the inner and outer periphery, respectfully, of the attached bladders.

11. A method for restraining a buoyancy compensation device comprising: providing a buoyancy compensation device including a bladder having an air chamber, a plurality of outer guide assemblies located about an outer periphery of the bladder, a corresponding plurality of inner guide assemblies located about an inner periphery of the bladder, and means for restraining the bladder disposed about the circumference of the bladder, passing the restraining means through at least one pair of corresponding inner and outer guide assemblies, and biasing the restraining means to exert a restraining force to limit expansion of the bladder prior to or when inflated to minimize a contour of the bladder when deflated, the decree of bias being sufficient to equalize air distribution when the bladder is partially inflated.

12. The method of claim 11 further comprising providing multiple restraining means distributed about the circumference of the bladder.

13. The method of claim 12 wherein the restraining means are each selectively placed about the circumference of the bladder.

14. The method of claim 12 wherein the restraining means are each selectively biased to adjust air distribution about the circumference of the bladder.

15. The method of claim 12 wherein the restraining means comprise bands, and further comprising tying the ends of each band together.

* * * * *